US008890793B2

(12) United States Patent
Wei et al.

(10) Patent No.: US 8,890,793 B2
(45) Date of Patent: Nov. 18, 2014

(54) ADJUSTING A BRIGHTNESS LEVEL OF A BACKLIGHT OF A DISPLAY DEVICE

(75) Inventors: Zhang Wei, New Territories (HK); Min Chen, Kowloon (HK); Tsai Chen Jung, Shatin (HK)

(73) Assignee: Hong Kong Applied Science and Technology Research Institute, Co. Ltd., Shatin (HK)

( * ) Notice: Subject to any disclaimer, the term of this patent is extended or adjusted under 35 U.S.C. 154(b) by 628 days.

(21) Appl. No.: 12/748,222

(22) Filed: Mar. 26, 2010

(65) Prior Publication Data

US 2011/0234612 A1 Sep. 29, 2011

(51) Int. Cl.
*G09G 3/36* (2006.01)
*G09G 3/34* (2006.01)

(52) U.S. Cl.
CPC ..... *G09G 3/3426* (2013.01); *G09G 2360/144* (2013.01); *G09G 2360/16* (2013.01); *G09G 2320/0646* (2013.01)
USPC ..... 345/102

(58) Field of Classification Search
USPC ..... 345/87–104
See application file for complete search history.

(56) References Cited

U.S. PATENT DOCUMENTS

2005/0184952 A1 8/2005 Konno et al.
2007/0097045 A1 5/2007 Lee et al.
2007/0159448 A1 7/2007 Inuzuka et al.
2007/0279369 A1 12/2007 Yao et al.
2008/0050031 A1* 2/2008 Itoh et al. ..... 382/260
2008/0252666 A1* 10/2008 Chen et al. ..... 345/690
2009/0079768 A1* 3/2009 Huang ..... 345/691
2009/0167671 A1 7/2009 Kerofsky
2009/0184917 A1* 7/2009 Park et al. ..... 345/102
2009/0219244 A1* 9/2009 Fletcher et al. ..... 345/102
2009/0278789 A1* 11/2009 Declercq et al. ..... 345/102
2010/0045694 A1 2/2010 Tanaka et al.
2010/0309109 A1 12/2010 Won
2011/0069078 A1 3/2011 Zhang et al.
2011/0141155 A1 6/2011 Hong et al.
2011/0234612 A1 9/2011 Wei

FOREIGN PATENT DOCUMENTS

CN 101281730 10/2008

OTHER PUBLICATIONS

U.S. Appl. No. 13/343,667: Application as Filed on Jan. 4, 2012, 52 Pages.
U.S. Appl. No. 13/343,667: Filing Receipt, Mailed Jan. 20, 2012, 3 Pages.
U.S. Appl. No. 13/343,667: Notice of Publication, Mailed May 3, 2012, 1 Page.
U.S. Appl. No. 13/343,667: Non-Final Office Action, Mailed Nov. 6, 2012, 9 Pages.
U.S. Appl. No. 13/343,667: Non-Final Office Action Response, Mailed Mar. 6, 2013, 22 Pages.
U.S. Appl. No. 13/343,667: Final Office Action, Mailed Nov. 8, 2013, 12 Pages.
U.S. Appl. No. 13/343,667: Request for Continued Examination, Mailed Apr. 7, 2014, 23 Pages.

* cited by examiner

*Primary Examiner* — Chanh Nguyen
*Assistant Examiner* — Sanghyuk Park
(74) *Attorney, Agent, or Firm* — Berkeley Law & Technology Group, LLP

(57) ABSTRACT

Embodiments of methods, systems, or apparatuses relating to adjusting a brightness level of at least a portion of a backlight of a display device based, at least in part, on one or more measurements of ambient light values.

18 Claims, 5 Drawing Sheets

| | | | | | |
|---|---|---|---|---|---|
| 5 | 10 | 20 | 30 | 50 | 30 |
| 80 | 40 | 70 | 10 | 100 | 50 |
| 100 | 255 | 100 | 120 | 30 | 10 |
| 70 | 10 | 20 | 30 | 0 | 0 |
| 20 | 0 | 40 | 0 | 0 | 0 |
| 0 | 0 | 0 | 0 | 0 | 0 |

FIG. 6a

| | | | | | |
|---|---|---|---|---|---|
| 0 | 0.3 | 0.5 | 0.5 | 0.3 | 0 |
| 0.3 | 0.8 | 1 | 1 | 0.8 | 0.3 |
| 0.5 | 1 | 1.5 | 1.5 | 1 | 0.5 |
| 0.5 | 1 | 1.5 | 1.5 | 1 | 0.5 |
| 0.3 | 0.8 | 1 | 1 | 0.8 | 0.3 |
| 0 | 0.3 | 0.5 | 0.5 | 0.3 | 0 |

FIG. 6b

| | | | | | |
|---|---|---|---|---|---|
| 0 | 3 | 10 | 15 | 15 | 0 |
| 24 | 32 | 70 | 10 | 80 | 15 |
| 50 | 255 | 150 | 180 | 30 | 5 |
| 35 | 10 | 30 | 45 | 0 | 0 |
| 6 | 0 | 40 | 0 | 0 | 0 |
| 0 | 0 | 0 | 0 | 0 | 0 |

FIG. 6c

ADJUSTING A BRIGHTNESS LEVEL OF A BACKLIGHT OF A DISPLAY DEVICE

BACKGROUND

1. Field

The subject matter disclosed herein relates to methods, systems, or apparatuses relating to adjusting a brightness level of at least a portion of a backlight of a display device.

2. Information

Backlights may be used as a light source in display devices, such as televisions, handheld devices, computer devices, or the like. Traditionally, backlights tended to provide a relatively constant or uniform intensity of light to a display panel. For example, light intensity for such backlights is typically uniform or constant spatially and temporally. More recently, however, backlights using local diming technology have been developed. In general, local diming approaches allow for brightness adjustment of specific portions of a backlight of a display device, such as adjusting a brightness of one or more luminescent bodies disposed on a backlight.

Depending on an environment in which display devices may be utilized, ambient light incident or around a display device may affect a viewer's ability to view an image on such a device. As just some examples, ambient light conditions may be such that an image on a display device may be cumbersome to view, cause viewer fatigue, exaggerate undesirable display characteristics, such as the "halo" effect, or occasion similar issues. Accordingly, there may be a desire to continue to develop approaches or techniques which may potentially mitigate undesirable display characteristics or improve display characteristics which are believed to be desirable.

BRIEF DESCRIPTION OF DRAWINGS

Subject matter is particularly pointed out and distinctly claimed in the concluding portion of the specification. Claimed subject matter, however, both as to organization and method of operation, together with objects, features, and advantages thereof, may best be understood by reference of the following detailed description if read with the accompanying drawings in which:

FIGS. 6*a*-6*c* depict exemplary values associated with determining a locally adjusted brightness value for at least one luminescent body of at least a portion of a backlight of a display device, according to an embodiment.

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, methods, apparatuses, or systems that would be known by one of ordinary skill have not been described in detail so as not to obscure claimed subject matter.

In addition, reference is made in the following detailed description to the accompanying drawings, which form a part hereof, wherein like numerals may designate like parts throughout to indicate corresponding or analogous elements. It will be appreciated that for simplicity or clarity of illustration, elements illustrated in the figures have not necessarily been drawn to scale. For example, the dimensions of some of the elements may be exaggerated relative to other elements for clarity. Further, it is to be understood that other embodiments may be utilized and structural or logical changes may be made without departing from the scope of claimed subject matter. It should also be noted that directions and references, for example, up, down, top, bottom, and so on, may be used to facilitate the discussion of the drawings and are not intended to restrict the application of claimed subject matter. Therefore, the following detailed description is not to be taken in a limiting sense and examples, illustrations, or the like, do not limit the scope of claimed subject matter defined by the appended claims and their equivalents.

Figure 4:
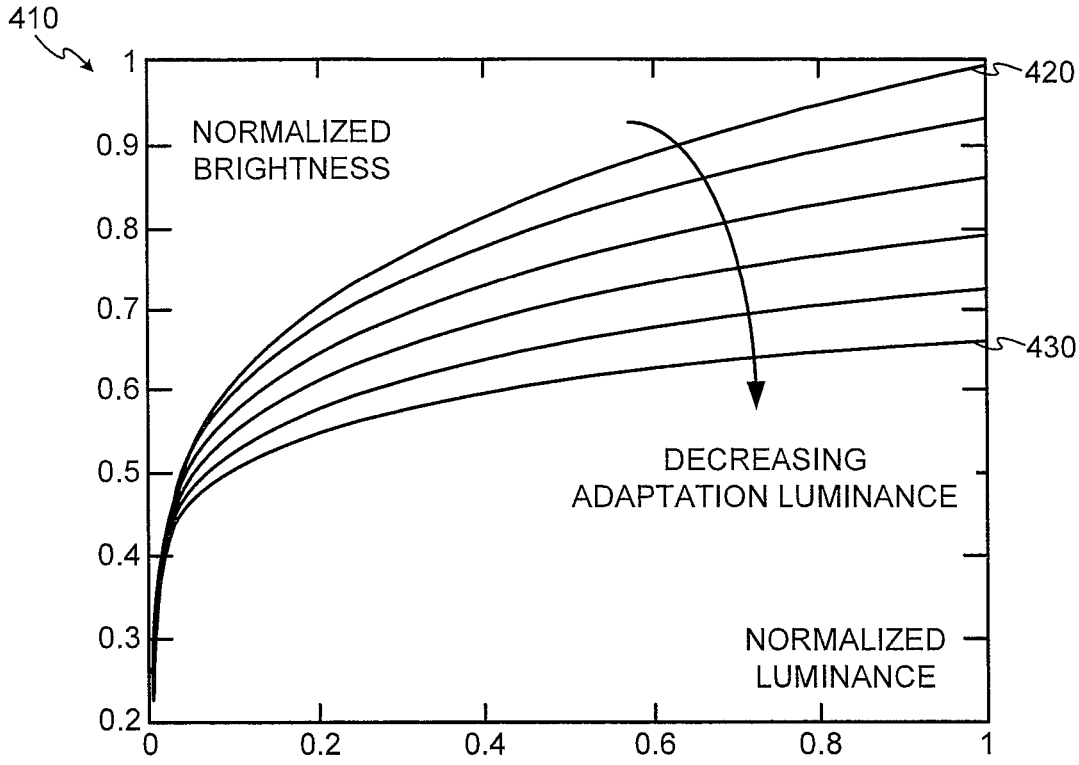
FIG. 4 depicts a chart which illustrates various exemplary brightness perception abilities of a human eye with respect to varying ambient light conditions.

As discussed above, backlights may be used as a light source in display devices, such as televisions, handheld devices, computer devices, and/or the like. As mentioned previously, ambient light incident or around such display devices may affect a viewer's ability to view a displayed image. In this context, ambient light around a display device may be affected by environmental lighting conditions in an area of a display device. This may in turn affect a viewer's ability to view the image displayed by the device. Such ambient light may cause undesirable display characteristics, such as a "halo" effect, as just an example. As just some examples, a displayed image may be too dim or too bright for a particular viewer in the presence of certain ambient light conditions. In brightly lit environments, for example, a viewer may have trouble viewing a displayed image which is too dim given such a brightly lit environment. For example, chart 410 in FIG. 4 illustrates various exemplary brightness perception abilities of a human eye with respect to varying ambient light conditions. In chart 410, profiles 420 and 430 may comprise two exemplary brightness perception abilities of a human eye with respect to varying ambient light conditions. Profile 420, for example, depicts that under "bright" ambient light conditions, a human eye may perceive a relatively wide range of brightness. Profile 430, in contrast, depicts the brightness perception abilities of the human eye under "dark" ambient light conditions. As may be seen from chart 410, when a bright image is displayed, a human eye may become more easily saturated and may not perceive that image with the same brightness level as the human eye may be able to perceive in a brighter environments. Thus, image display characteristics in certain ambient lighting environments may occasion numerous physiological issues for the viewer, such as eye fatigue, eye strain, or the like, as just some examples.

In addition to potentially undesirable display characteristics, certain ambient light conditions may use potentially undesirable thermal management or power consumption characteristics under particular ambient light conditions. For instance, in dimly lit environments, a particular display device may display an image which is unnecessarily bright in the presence of a particular ambient light condition. As such, these display devices may utilize undesirable amounts of power, generate undesirable quantities of heat, or have other related issues, for example. Accordingly, there may be a desire to continue to develop approaches or techniques to potentially mitigate undesirable display characteristics and/or improve display characteristics which are believed to be desirable.

With these and other concerns in mind, in accordance with certain aspects of the present description, example implementations may include methods, systems, or apparatuses for adjusting a brightness level of at least a portion of a backlight of a display device based, at least in part, on one or more measurements of ambient light values. In certain embodiments, for example, adjusting a brightness level of at least a portion of a backlight of a display device based, at least in part, on one or more measurements of ambient light values may include non-uniformly adjusting a brightness of at least a plurality of luminescent bodies disposed as part of a backlight. In this context, a "brightness" or "brightness level" of a luminescent body, such as may be measured in cd/m$^2$, may correspond to one or more intensities associated with one or more signal values which may control a brightness of a luminescent body. Accordingly, in certain embodiments, adjusting a brightness level may include adjusting an intensity associated with one or more such signal values, as just an example.

Figure 1:
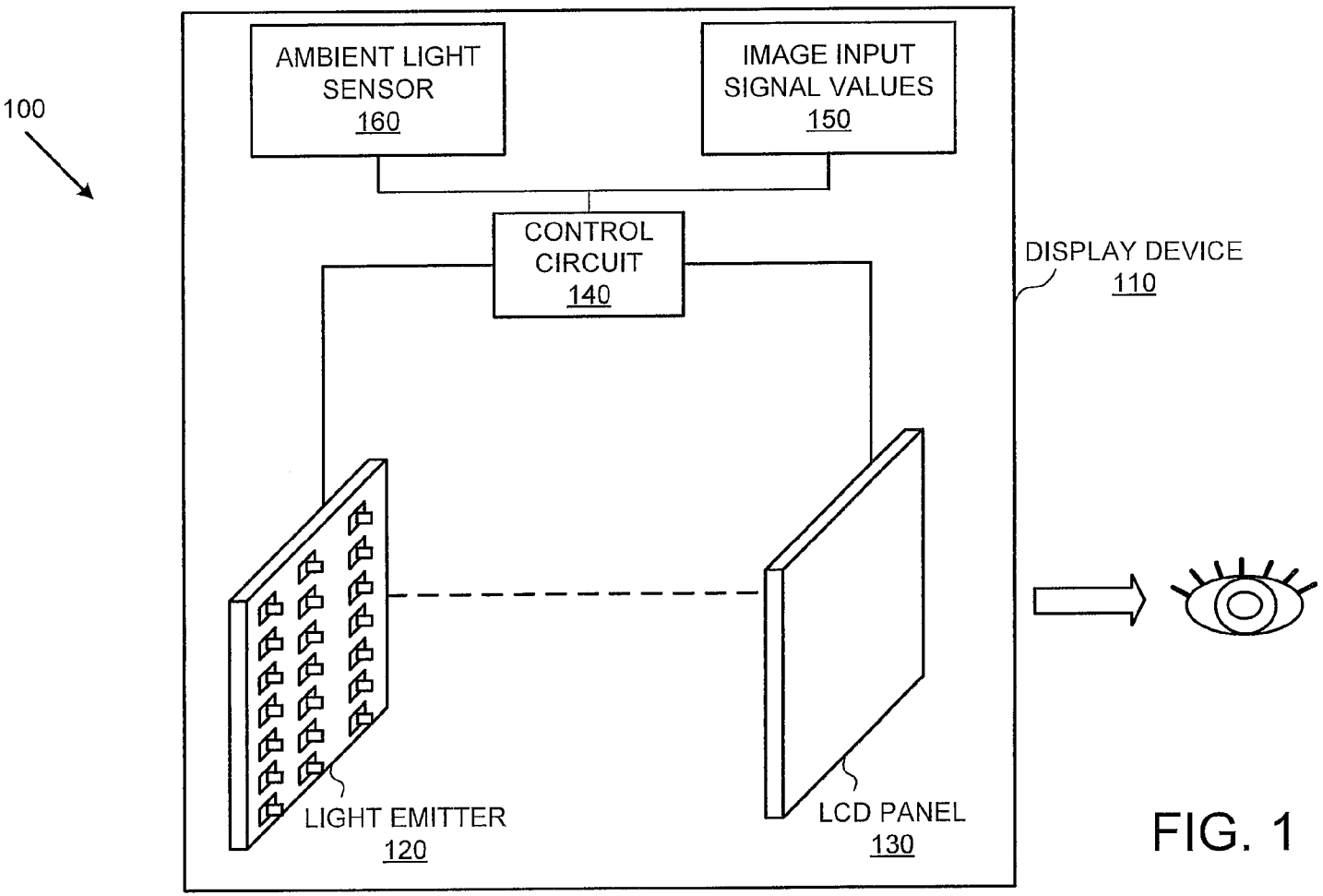
FIG. 1 is a schematic diagram depicting an embodiment of an exemplary display device capable of adjusting a brightness level of at least a portion of a backlight of a display device.

FIG. 1 is a schematic diagram depicting embodiment 100 of an exemplary display device 110 which is capable of adjusting a brightness level of at least a portion of a backlight of a display device based, at least in part, one or more measurements of ambient light values. Here, for example, display device 110 may comprise any display device, such as a television, a handheld device, a computer device, or the like, as non-limiting examples. It should be noted that, for illustrative purposes, embodiment 100 depicts a simplified representation of display device 110. Accordingly, display device 110 may include numerous components, devices, etc., which have not been depicted in embodiment 100 so as to not obscure claimed subject matter. Thus, display device 110 may include one or more image processors, diffusers, drivers, microcontrollers, microprocessors, memories, buses, sensors, filters, or other components or devices, as non-limiting examples. Of course, many of these omitted components or devices may perform, in whole or in part, one or more of the functions described herein.

Display device 110 is depicted having a light emitter 120 which includes an array of luminescent bodies. In this context, a luminescent body means a body capable of emitting light. For instance, a luminescent body associated with light emitter 120 may comprise a light emitting diode (LED), a cold cathode fluorescent lamp (CCFL), a surface conduction electron emitter display (SED), a field emission display (FED), or the like, as non-limiting examples. Accordingly, in certain embodiments, light emitter 120 may comprise a backlight including a plurality of LEDs disposed in an array. In certain embodiments, LEDs may have multiple color channels, as just an example.

Display device 110 is depicted having a liquid crystal display (LCD) panel 130. In particular implementations, an LCD may employ a backlight to produce light since LCDs are generally not capable of doing so. Thus, in display device 110, light emitter 120 is depicted as being coupled with LCD panel 130. In embodiment 100, light emitter 120 may emit light, some of which may pass through LCD panel 130, as depicted by the direction the arrow in FIG. 1, to a viewer's eye.

In embodiment 100, control circuit 140 may comprise a microcontroller, microprocessor, integrated chip (IC), and/or the like, as non-liming examples. As suggested above, control circuit 140 is depicted being electrically coupled to light emitter 120 and LCD panel 130. In embodiment 100, control circuit 140 may receive one or more input image signal values, such as image input signal value 150, for example. In certain embodiments, image input signal values 150 may comprise binary digital signals representative of one or more images, such as one or more image frames, for example. Accordingly, image input signal values 150 may include image signal values which, if processed, may correspond, at least in part, to brightness or intensity values for one or more luminescent bodies associated with light emitter 120, as just an example.

In embodiment 100, display device 110 is depicted having ambient light sensor 160. Ambient light sensor 160 may comprises any device or component capable of measuring, sensing, or otherwise determining one or more ambient light values associated with display device 110. For example, ambient light sensor 160 may include one or more photo diodes, photo resistors, and/or photo transistors, as non-limiting examples. Ambient light values associated with a display device may represent, as some non-limiting examples, a quantum or intensity of light incident on at least a portion of a surface of display device or a quantum or intensity of light around a display device (e.g., environmental lighting conditions), such as may be measured in lux, as just an example. Here, it is noted that claimed subject matter is not to be limited to any particular sensor type, method or technique for sensing, nor is sensing limited spatially or temporally to particular environments or conditions. For example, in certain embodiments, ambient light sensor 160 may be operable to measure, sense, or otherwise determine ambient light conditions proximate to the device, such as in an area within a couple feet around the device, or remote from the device, such as in a large area or room, as just some examples. In certain embodiments, ambient light sensor 160 may be a component or device which may be physically detached from display device 110 (not depicted). For example, in particular embodiments, ambient light sensor 160 may communicate wirelessly with control circuit 140. In certain embodiments, ambient light sensor 160 may comprise at least a part of control circuit 140 or be integrated with various other components or devices (not depicted), as just another example.

As mentioned above, in certain embodiments, control circuit 140 is capable of non-uniformly adjusting a brightness of at least a plurality of luminescent bodies of light emitter 120 based, at least in part, on one or more measurements of ambient light values determined by ambient light sensor 160. For example, in certain embodiments, control circuit 140 may generate one or more locally adjusted brightness values corresponding to one or more luminescent bodies using image input signal values 150 and one or more ambient light measurements from ambient light sensor 160. To perform one or more of these various operation, control circuit 140 may utilize one or more of approaches or techniques described herein, such as in FIG. 2, for example.

Also, in certain embodiments, control circuit 140 may generate a globally adjust brightness value corresponding to one or more luminescent bodies using one or more locally adjusted brightness values and one or more ambient light measurements. Furthermore, control circuit 140 may be capable transmitting or outputting one or more locally and/or globally adjusted brightness values to adjust one or more pixel values of an LCD panel, as just an example. Accordingly, in certain embodiments, control circuit 140 may adjust one or more pixel values, such as red, green, or blue pixel values of LCD panel 130 based, at least in part, on one or more locally or globally adjusted brightness values, as just an example. To perform one or more of these various operations, control circuit 140 may utilize one or more of approaches or techniques described herein, such as in FIG. 2, for example. Of course, as mentioned previously, while one or more processes or operations depicted in FIG. 2 may be performed by a control circuit, such as control circuit 140, one or more of such processes or operations may be performed in certain embodiments, in whole or in part, via various components or devices. Accordingly, the scope of claimed subject matter is not limited to examples or illustrations.

Figure 2:
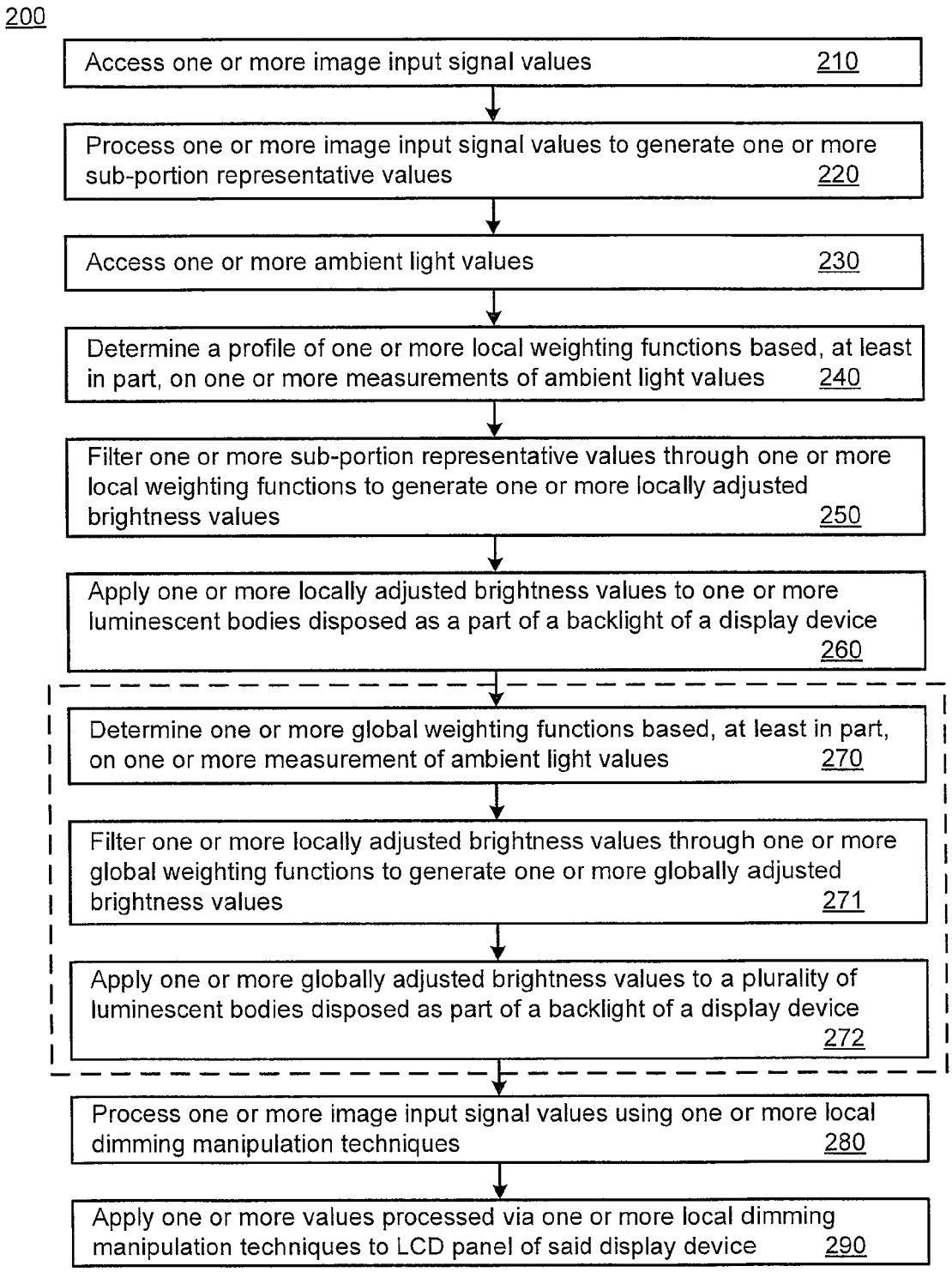
FIG. 2 is a flow diagram depicting an embodiment of an exemplary method for adjusting a brightness level of at least a portion of a backlight of a display device.

FIG. 2 depicts an embodiment of an exemplary method for adjusting a brightness level of at least a portion of a backlight of a display device based, at least in part, one or more measurements of ambient light values. At block 210, a process, system or apparatus may access one or more image input signal values, such as image input signal values 150. As mentioned previously, image input signal values may comprise binary digital signals representative of one or more images, such as one or more image frames, which, if processed, may correspond, at least in part, to brightness or intensity values corresponding to one or more luminescent bodies, as just an example. As discussed in more detail below, such image input signal values may be processed to generate one or more sub-portion representative values. In certain embodiments, one or more sub-portion representative values may be filtered through one or more local weighting functions to generate one or more locally adjusted brightness values. In this context, a local weighting function comprises a function which may be applied to one or more sub-portion representative values which correspond to luminescent bodies disposed on a portion of a backlight. Such values are discussed in more detail below. In addition, in certain embodiments, one or more image input signal values may be processed using one or more local dimming manipulation techniques. In certain embodiments, such processing using one or more local dimming manipulation techniques may be performed according to the one or more signal values corresponding to one or more luminescent bodies, such as described in more detail below. In certain embodiments, one or more values processed via one or more local dimming manipulation techniques may be applied to an LCD panel of said display device, in certain embodiments.

As suggested above, at block 220, a process, system or apparatus may process one or more image input signal values to generate one or more sub-portion representative values. Since a variety of ways may exist to perform this operation, it would not be feasible to list all such techniques. In is noted, then, that while claimed subject matter is not to be limited to any particular technique or approach, one technique that may be utilized at block 220, for example, is described in U.S. patent application Ser. No. 12/565,635 entitled, "Method, system or apparatus for adjusting a brightness level associated with at least a portion of a backlight of a display device," filed on Sep. 23, 2009. A simplified recitation of this technique is described below.

According to the above-referenced patent application, image information, such as image frames, may be partitioned, portioned, or otherwise divided, such as by a control circuit, into a plurality of image portions. Such image portions may be further portioned into a plurality of image sub-portions from one or more of image portions. For one or more such image sub-portions, a representative signal value may be determined. As described in the above-referenced patent application, a representative signal values may comprise one or more values which represent image properties associated with image sub-portions, such as intensity, brightness, peak or average luminance value, peak or average value for color channels, or the like, as just a few examples. To illustrate, paraphrasing the above-referenced patent application, a representative signal values may be selected by using a peak subpixel signal value (e.g., $Peak_i=Max(R_i, G_i, B_i)$) associated with a particular image sub-portion. Here, subpixel values may comprise $R_i$, $G_1$, $B_i$ which represent intensity or brightness values, i, associated with red, green, and blue color channels, respectively, for a particular image sub-portion, as an example. Thus, in certain embodiments, a representative value associated with a particular image sub-portion may be determined as: Representative Value=Max(subpixel signal $value_{ij}$) for an image sub-portion. Here, the subscript "ij" may designate a particular image sub-portion, such as using a Cartesian coordinate system identifying a particular image sub-portion located at row i, column j, as just an example.

Figure 3:
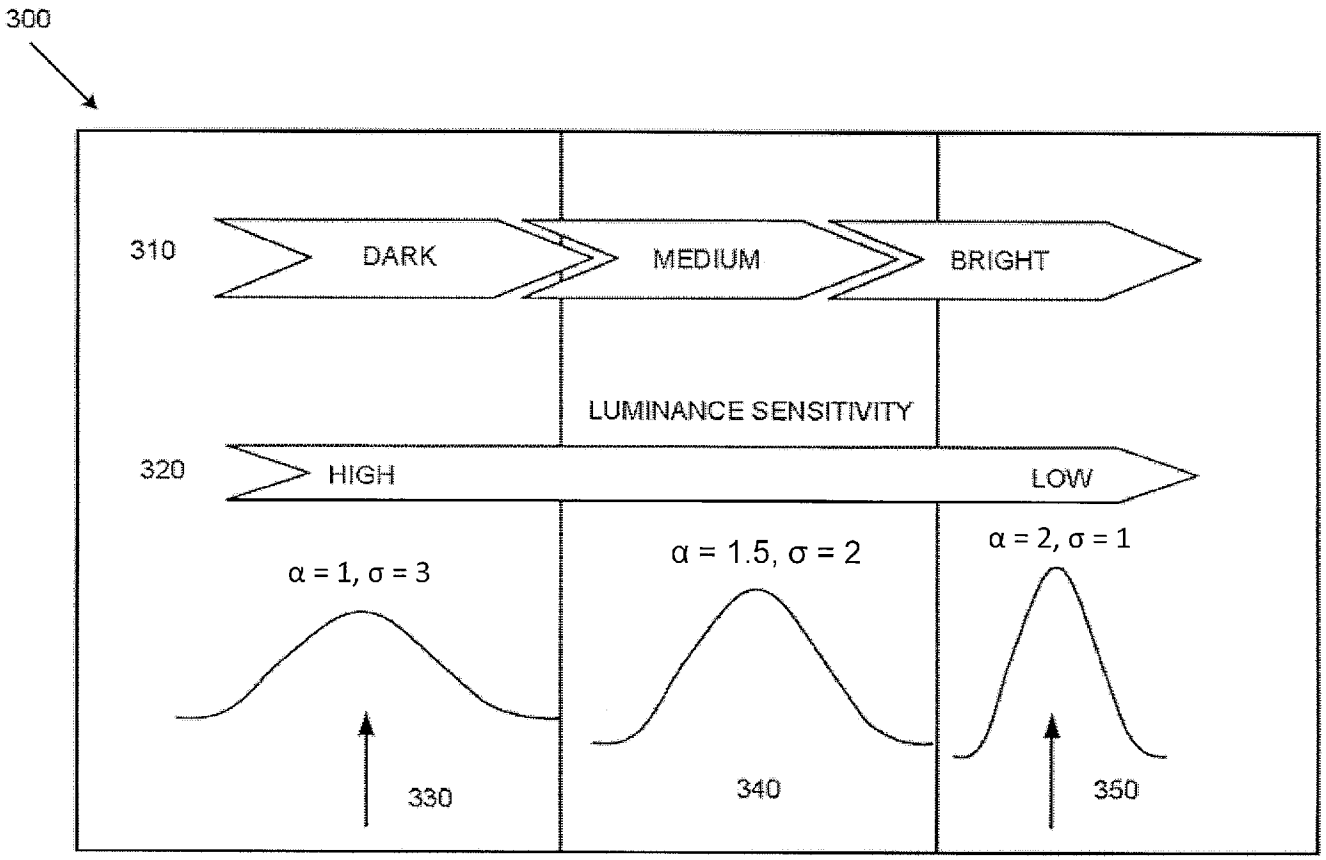
FIG. 3 illustrates exemplary local weighting functions used to adjust a brightness level of at least a portion of a backlight of a display device, in accordance with one or more embodiments.

At block 230, a process, system or apparatus may access one or more measurements of ambient light values, such as access one or more ambient light values determined by ambient light measurements performed by ambient light sensor 160 in FIG. 1, for example. In certain embodiments, at block 240, a process, system or apparatus may determine and/or select a profile of one or more local weighting functions based, at least in part, on one or more measurements of ambient light values. For example, as mentioned above, ambient light values may be measured in lux. In certain embodiments, depending on a quantum of lux sensed, measured, or detected, a process, system or apparatus at block 240 may determine a particular profile of a local weighting function. Generally speaking, ambient light values which may correspond to higher lux (e.g., brighter) ambient lighting conditions may result in a "sharper" local weighting function being determined, whereas ambient light values corresponding to lower lux (e.g., dimmer) ambient lighting conditions may result in a "smoother" local weighting function being determined. FIG. 3, for example, shows various, exemplary profiles of local weighting functions which may be determined and be used to adjust a brightness level of one or more luminescent bodies of at least a portion of a backlight of a display device, in accordance with one or more embodiments.

In FIG. 3, ambient lighting conditions scale 310 is provided as an exemplary reference to show types of profiles which may be determined based on one or more ambient light values. Regarding this scale, it is noted that any values, such as values expressed in lux, which may be referenced as corresponding to "dark" "medium" or "bright" ambient light conditions, are labeled as such merely for illustrative purposes. Similarly, exemplary local weighting functions 330-350 depicted as corresponding to "dark" "medium" or "bright" ambient light values are also illustrative. Likewise, scale 320 depicts an exemplary scale of the sensitivity of a viewer's eye in "dark" "medium" or "bright" ambient light conditions. Accordingly, the scope of claimed subject matter is not limited to such illustrations or examples.

For illustrate purposes, local weighting functions 330-350 may comprise Gaussian functions represented by the following equation:

$$G = \alpha \cdot e^{\sigma^{\frac{-x^2}{2}}},$$

where $\alpha$ represents an enhancement factor, $\sigma$ represents a standard deviation, and x represents a distance from a particular luminescent body. Here, in FIG. 3, scale 310 first depicts "dark" ambient lighting conditions, such as those corresponding to between 0 to approximately 200 lux. Here, a "smooth" local weighing function, such as local weighting function 330, may be determined based on "dark" ambient lighting conditions. Accordingly, local weighting function 330 may have an enhancement factor of 1.0 and a standard deviation of 3.0 for such ambient lighting conditions. In contrast, in "bright" ambient lighting conditions, such as those which may correspond lux values exceeding approximately 4000 lux, as just an example, local weighting function 350 may be determined, as yet another example. Here, it is noted that FIG. 3 depicts a scale which may be non-liner to the extent that a characterization of lux corresponding to "dark", "medium" or "bright" ambient light conditions may vary according to the brightness perception characteristics of the human eye. Accordingly, the characterizations of lux corresponding to particular "dark", "medium" or "bright" ambient light condition is done merely for convenience and simplicity; accordingly, the scope of claimed subject matter is not to be limited by such characterizations.

In certain embodiments, particular profiles of local weighting functions may be determined so as to produce particular display characteristics. For instance, an enhancement factor of 1.0 and a standard deviation of 3.0 associated with local weighing function 330, for example, may have an effect of lowering a contrast between and/or among one or more luminescent bodies neighboring a particular luminescent body disposed on at least a portion of a backlight of a display device. Likewise, an enhancement factor of 2.0 and a standard deviation of 1.0 associated with local weighing function 350, for example, may have an effect of increasing a contrast between and/or among one or more luminescent bodies neighboring a particular luminescent body disposed on at least a portion of a backlight of a display device. As may be apparent from the foregoing, a vast number of profile shapes may be determined based on a variety of ambient light values; accordingly, the scope of claimed subject matter is not to be limited to any examples or illustrations.

At block 250 in FIG. 2, a process, system or apparatus may filter one or more sub-portion representative values through one or more local weighting functions to generate one or more locally adjusted brightness values. For example, one or more sub-portion representative values may be filtered through a local weighting function, such as one or more local weighting functions depicted in FIG. 3, as just an example. Here, filtering may result in generating one or more locally adjusted brightness values.

At block 260, a process, system or apparatus may apply such locally adjusted brightness values to one or more luminescent bodies disposed as a part of a backlight of a display device. For example, in certain embodiments, a brightness level of a plurality of luminescent bodies may be non-uniformly adjusted by applying one or more of the locally adjusted brightness values to a plurality of luminescent bodies disposed as part of a backlight. In certain embodiments, a filtering of a local weighting function may produce non-uniform locally adjusted brightness values to be applied a particular luminescent body, where the locally adjusted brightness values associated with that particular luminescent body may be affected by one or more proximate sub-portion representative values at a certain distance X (as expressed in the above equation) from the particular luminescent body. In effect, a local weighting function may act like a low pass filter which affects intensity values associated with one or more proximate luminescent bodies non-uniformly at a certain distance X from a particular luminescent body.

To illustrate a few of the above processes or operations, suppose control circuit 140 in FIG. 1 may adjust a brightness of one or more luminescent bodies depicted in FIG. 6*a* (3×3 array where black dots depict luminescent bodies disposed as a portion of a backlight of a display device). Here, for example, control circuit 140 may access one or more image input signal values (which control circuit 140 may process, or which may already be processed, to generate one or more sub-portion representative values) which may correspond to the 3×3 array. Suppose, for sake of illustration, that sub-portion representative values for the 3×3 array may be determined as described in the above-reference patent (e.g., Representative Value=Max(subpixel signal value$_{ij}$) and are represented by the values depicted in FIG. 6*a*.

In this illustration, control circuit 140 may access one or more ambient light values and, based at least in part, on such values may determine a profile of one or more weighting functions. For sake of illustration, assume that a local weighting function is determined which corresponds to the values depicted in FIG. 6*b*. Continuing with the illustration, control circuit 140 may filter one or more of the above sub-portion representative values (as depicted in FIG. 6*a*) through the local weighting function (as depicted in FIG. 6*b*) as just an example, to produce filtered values depicted in FIG. 6*c*.

An effect of filtering sub-portion representative values through a local weighting function may be to determine one or more locally adjusted brightness values which may individually and/or non-uniformly adjust a brightness of a plurality of luminescent bodies depicted in the above 3×3 array. Here, one or more locally adjusted brightness values may be determined based, at least in part, according to the equation "luminescent body value=max(R_Neighbor i,j·Weight i,j)". Accordingly, if a locally adjust brightness value were to be determined based, at least in part, on R_Neighbor i,j·Weight i,j for the centered luminescent body in the 3×3 array depicted in FIG. 6*c*, a locally adjusted brightness value for that centered luminescent body may be 255, as just an example. Of course, in certain embodiments, one or more of the above processes may be employed to determine one or more locally adjusted brightness values for one or more individual luminescent bodies disposed as at least a portion of a backlight such as described in the above illustration for the centered luminescent body on the 3×3 array. In certain embodiments, control circuit 140 in this illustration may apply a plurality of such locally adjusted brightness values to a plurality of luminescent bodies. In such a manner, control circuit 140 may individually and/or non-uniformly adjust a brightness level of one or more luminescent bodies disposed as a portion of a backlight of a display device, as just an example.

Additionally, as mentioned above, in certain embodiments, one or more locally adjusted brightness values may be optionally filtered by one or more global weighting functions. For example, in certain embodiments, at block 270, a process, system or apparatus may optionally determine one or more global weighting functions based, at least in part, on one or more ambient light values. Here, a global weighting function may comprise a weighting function that is uniformly applied to a plurality of locally adjusted brightness values.

For example, in certain embodiments, at block 271, a process, system or apparatus may filter one or more locally adjusted brightness values through one or more global weighting functions to generate one or more globally adjusted brightness values. In this context, a global weighting function comprises a function which may be applied to locally adjusted brightness values which correspond to a plurality of luminescent bodies disposed on a portion of a backlight. To illustrate, suppose control circuit 140 in FIG. 1 may globally and/or uniformly adjust a plurality of luminescent bodies in the above-mentioned 3×3 array. Here, for example, control circuit 140 may determine a global weighting function based, at least in part, on one or more ambient light values.

Figure 5:
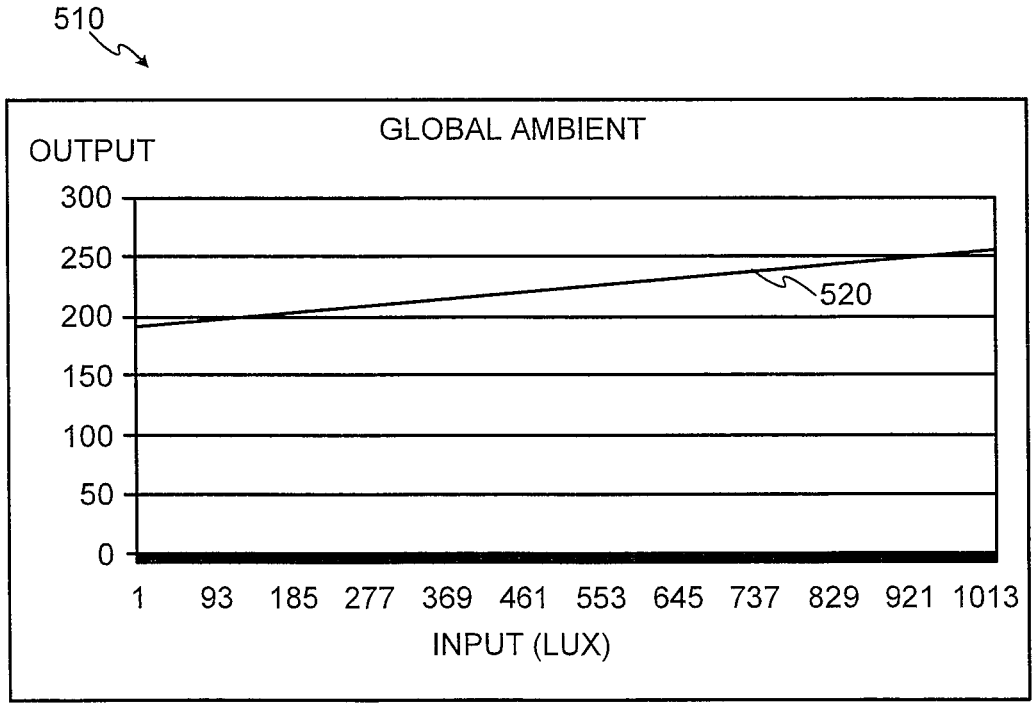
FIG. 5 depicts a chart which illustrates an exemplary global weighting function, in accordance with an embodiment.

In certain embodiments, at block 272, a process, system or apparatus may apply globally adjusted brightness values to a plurality of luminescent bodies disposed as part of a backlight of a display device. For example, FIG. 5 is a chart which depicts an exemplary global weighting function, in accordance with an embodiment. The x-axis of chart 510, for example, depicts exemplary ambient light input and the y-axis depicts a global weighting function corresponding to exemplary ambient light values (lux) in the x-axis. As may be apparent from chart 510, in some instances, an effect of an applied globally adjusted brightness value may be to uniformly adjust a brightness of a plurality of luminescent bodies disposed as part of a backlight based, at least in part, on ambient light values. Here, for example, line 520 may depict a global weighting function which may increase as ambient light values increase and/or decrease as ambient light values decrease. As an exemplary illustration, a signal value intensity of 255, depicted at the far right of line 520 may correspond to a global weighting of 1.0, whereas a signal value intensity of less than 255, such as a value of X, may receive a global weighting function selected as X/255, as just an example. In certain embodiments, control circuit 140 may apply one or more globally adjusted brightness values to a plurality of luminescent bodies associated with that array, as just an example. Of course, it is noted that the global weighting function depicted in chart 510 is merely exemplary and, accordingly, the scope of claimed subject matter is not to be limited.

In certain embodiments, in some devices or configurations, a light emitter (e.g., backlight) and an LCD panel, such as light emitter 120 and LCD panel 130, may be coupled via a control circuit such that a control circuit is operable to adjust a transmissivity of the liquid crystal based, at least in part, in response to light incident on the LCD panel from a light emitter. Thus, as just an example, a control circuit may adjust a transmissivity of an LCD panel in response to one or more backlight adjustments, such as adjustments based at least in part on ambient light values as previously described. Of course, such LCD adjustments may be controlled by one or more components or devices which, for sake of illustration, are not depicted in FIG. 1. For instance, light emitter 120 and/or LCD panel 130 may have various processors, control circuits, or drivers which control one or more interactions between light emitter 120 and LCD panel 130. For convenience, however, and so as to not obscure claimed subject matter, these components or devices are omitted; instead, in embodiment 100, control circuit 140 may perform one more of the functions associated with these various components or devices.

For example, in certain embodiments, at block 280, one or more processes or devices, such as control circuit 140, may adjust an image signal value corresponding to an LCD panel at least in part in response one or more backlight intensity adjustments. To do so, control circuit 140 may process one or more input image signal values using one or more local dimming manipulation techniques. In this context, a local dimming manipulation technique may comprise any technique or approach to selectively modulate a brightness level of LCD transmissivity. Since a variety of local dimming techniques exist, it would not be feasible to list all such techniques. In is noted, then, that while claimed subject matter is not to be limited to any particular technique or approach, one local dimming manipulation technique that may be utilized at block 220, for example, is described in aforementioned U.S. patent application Ser. No. 12/565,635 entitled, "Method, system or apparatus for adjusting a brightness level associated with at least a portion of a backlight of a display device," filed on Sep. 23, 2009. At block 290, one or more processes or operations may apply one or more values processed via one or more local dimming manipulation techniques to adjust a transmissivity of an LCD panel of a display device.

Certain implementations or embodiments may have a variety of advantages. For example, exemplary advantages associated with at least one embodiment may include potentially improved power savings and thermal management characteristics. In certain embodiments, power saving and thermal management may improve, for example, due in part to localized adjustments of backlight intensity based on ambient light incident on or around a particular display device. In addition, exemplary advantages related to display characteristics associated with at least one embodiment may include potentially improved contrast or color performance ratios, as just an example.

The terms, "and," "and/or," and "or" as used herein may include a variety of meanings that will depend at least in part upon the context in which it is used. Typically, "and/or" as well as "or" if used to associate a list, such as A, B or C, is intended to mean A, B, and C, here used in the inclusive sense, as well as A, B or C, here used in the exclusive sense. Reference throughout this specification to "one embodiment" or "an embodiment" or a "certain embodiment" means that a particular feature, structure, or characteristic described in connection with the embodiment is included in at least one embodiment of claimed subject matter. Thus, the appearances of the phrase "in one embodiment" or "an embodiment" or a "certain embodiment" in various places throughout this specification are not necessarily all referring to the same embodiment. Furthermore, the particular features, structures, or characteristics may be combined in one or more embodiments. Embodiments described herein may include machines, devices, engines, or apparatuses that operate using digital signals. Such signals may comprise electronic signals, optical signals, electromagnetic signals, or any form of energy that provides information between locations.

In the preceding description, various aspects of claimed subject matter have been described. For purposes of explanation, specific numbers, systems and/or configurations were set forth to provide a thorough understanding of claimed subject matter. However, it should be apparent to one skilled in the art having the benefit of this disclosure that claimed subject matter may be practiced without the specific details. In other instances, features that would be understood by one of ordinary skill were omitted or simplified so as not to obscure claimed subject matter. While certain features have been illustrated or described herein, many modifications, substitutions, changes or equivalents will now occur to those skilled in the art. It is, therefore, to be understood that the appended claims are intended to cover all such modifications or changes as fall within the true spirit of claimed subject matter.

The invention claimed is:

1. A method, comprising:

non-uniformly adjusting a brightness of at least a plurality of luminescent bodies disposed as part of a backlight of a display device based, at least in part, on one or more measurements of ambient light values determined, at least in part, by said display device;

generating at least one locally adjusted brightness value for at least one of said plurality of luminescent bodies based, at least in part, on one or more sub-portion representative values filtered by at least one local weight functions; and selecting a profile for said at least one local weighting functions for filtering representative values for one or more sub-portions of said display device, wherein said profile of said one or more local weighting functions is selected based, at least in part, on said one or more measurements of ambient lights values, a contrast of said profile being increased and standard deviation of said profile being decreased with respect to an increment of the brightness of said ambient light values.

2. The method of claim 1, wherein said one or more local weighting functions comprises a Gaussian function.

3. The method of claim 1, further comprising:

accessing at least one of said image input signal values; and processing at least one of said image input signal values to generate one or more sub-portion representative values.

4. The method of claim 1, further comprising:

determining a global weighting function based, at least in part, on one or more measurements of ambient light values determined, at least in part, by said display device.

5. The method of claim 4, further comprising:

filtering one or more locally adjusted brightness values through said global weighting function to generate a plurality of globally adjusted brightness values.

6. The method of claim 5, further comprising:

applying said plurality of globally adjusted brightness values to a plurality of luminescent bodies disposed as part of said backlight of a display device.

7. The method of claim 1, further comprising:

dividing an input image into a plurality of portions, wherein each of said plurality of portions corresponds to one of said plurality of luminescent bodies;

dividing each of said plurality of portions into a plurality of sub-portions;

generating said at least one locally adjusted brightness value for at least one of said plurality of luminescent bodies based, at least in part, on representative values of a group of sub-portions filtered by said at least one local weighting function; and selecting the profile for said at least one local weighting function for filtering representative values of said group of sub-portions of said display device, wherein said profile is a decreasing profile with respect to increased distances between said group of sub-portions and said particular luminescent body.

8. An apparatus, comprising:

a light emitter comprising an array of luminescent bodies;

an LCD panel coupled to said light emitter; and a control circuit electrically coupled to said light emitter and said LCD panel, wherein said control circuit is capable of non-uniformly adjusting a brightness of at least a plurality of luminescent bodies disposed as part of a backlight of a display device based, at least in part, on one or more measurements of ambient light values determined, at least in part, by said display device, said control circuit generating at least one locally adjusted brightness value for at least one of said plurality of luminescent bodies based, at least in part, on one or more sub-portion representative values filtered by one or more local weighting functions, said control circuit additionally selecting a profile for said one or more local weighting functions for filtering representative values for a sub-portions of said display device, wherein said profile of said local weighting functions is selected bases, at least in part, on said one or more measurements of ambient light values, and wherein a contrast of said profile of said local weighting functions is increased and standard deviation of said profile of said local weighting functions is increased and standard deviation of said profile brightness of said ambient light values.

9. The apparatus of claim 8, wherein said control circuit is capable of accessing one or more image input signal values; wherein said control circuit is further capable of processing at least one of said one or more image input signal values to generate said one or more sub-portion representative values.

10. The apparatus of claim 9, wherein said control circuit is further capable of processing said one or more image input signal values using one or more local dimming manipulation techniques.

11. The apparatus of claim 8, wherein said control circuit is capable of applying one or more values generated using one or more local dimming manipulation techniques to at least a portion of said LCD panel to adjust one or more LCD pixel values, at least in part.

12. The apparatus of claim 8, further comprising:

at least one ambient light sensor; wherein said ambient light sensor is capable of measuring ambient light incident on or around said display device to determine one or more of said ambient light values.

13. The apparatus of claim 8, wherein said control circuit is capable of determining one or more local weighing functions based, at least in part, on said one or more measurements of ambient light values determined, at least in part, by said display device; wherein said control circuit is further capable of filtering one locally adjusted brightness values through said global weighting functions to generate a plurality of globally adjusted brightness values.

14. The apparatus of claim 8, wherein said array of luminescent bodies comprises a plurality of light emitting diodes.

15. The apparatus of claim 8, wherein said light emitter, said LCD panel, and said control circuit comprise at least a portion of said display device, said display device being capable of displaying an image.

16. The apparatus of claim 15, wherein said display device capable of displaying an image comprises at least one of the following:

a television, a handheld device, a computer device, or combinations thereof.

17. An apparatus, comprising:

means for determining one or more ambient light values;

means for individually adjusting a brightness of at least one luminescent body disposed as part of an array of luminescent bodies comprising at least a portion of a backlight of a display device based, at least in part, on said one or more ambient light values associated with said display device;

means for generating at least one locally adjusted brightness value for at least one of said luminescent bodies based, at least in part, on one or more sub-portion representative values filtered by one or more local weighting functions; and means for selecting a profile for said one or more local weighting functions for filtering representative values for a sub-portion of said display device, wherein said profile of said one or more local weighting functions is selected based, at least in part, on said one or more measurements of ambient light values, and wherein a contrast of said profile is increased and standard deviation of said profile is decreased with respect to an increment of the brightness of said ambient light values.

18. A method, comprising:

non-uniformly adjusting a brightness of a plurality of luminescent bodies disposed as part of a backlight of a display device based, at least in part, on one or more measurements of ambient light values determined, at least in part, by said display device;

generating at least one locally adjusted brightness value for at least one of said plurality of luminescent bodies based, at least in part, on one or more sub-portion representative values filtered by at least one local weighting function; and selecting a profile for said at least one local weighting functions for filtering representative values for one or more sub-portions of said display device, wherein said profile of said one or more local weighting functions is selected based, at least in part, on said one or more measurements of ambient light values, an enhancement factor of said profile being increased and standard deviation of said profile being decreased with respect to an increment of the brightness of said ambient light values.

* * * * *